United States Patent [19]

Serino et al.

[11] 4,268,309

[45] May 19, 1981

[54] WEAR-RESISTING SINTERED ALLOY

[75] Inventors: Yoichi Serino, Toyota; Tetsuya Suganuma, Nagoya; Yoshitaka Takahashi, Toyota, all of Japan

[73] Assignee: Toyota Jidosha Kogyo Kabushiki Kaisha, Toyota, Japan

[21] Appl. No.: 960,637

[22] Filed: Nov. 14, 1978

[30] Foreign Application Priority Data

Jun. 23, 1978 [JP] Japan ..... 53-076107

[51] Int. Cl.[3] ..... B22F 5/00

[52] U.S. Cl. ..... 75/230; 75/246; 75/125; 75/126 K; 75/126 R; 75/126 A; 75/126 C; 75/237

[58] Field of Search ..... 75/246, 125, 126 R, 75/126 A, 126 K, 126 C, 230, 237

[56] References Cited

U.S. PATENT DOCUMENTS

| | | | |
|---|---|---|---|
| 3,694,173 | 9/1972 | Farmer et al. | 75/126 A |
| 3,941,589 | 3/1976 | Norman et al. | 75/125 |
| 3,977,838 | 8/1976 | Hashimoto et al. | 75/244 |
| 4,035,159 | 7/1977 | Hashimoto et al. | 75/126 R |

*Primary Examiner*—Brooks H. Hunt

*Attorney, Agent, or Firm*—Brisebois & Kruger

[57] ABSTRACT

Wear-resisting iron base sintered alloy obtained by sintering a metal powder composed of, by weight, 15–25% chromium, 0–3% molybdenum, 1–5% copper, 0.3–0.8% phosphorus and 2.0–4.0% carbon, with the balance iron and less than 2% impurities, to a density of more than 7.3 g/cm$^3$.

10 Claims, 3 Drawing Figures

WEAR-RESISTING SINTERED ALLOY

BACKGROUND OF THE INVENTION

Among the parts of a machine, the slidable ones which operate under a relatively high plane pressure usually defy formation of a stable lubricant film and therefore their materials are required to be highly resistant to wear and pitting. Materials presently available are surface-hardened ones including quenched steel with high hardness, chilled cast iron, hard chromium-plated or soft-nitrided steel, but they can not always meet the requirements, many of them suffering troubles like wear or pitting. Meanwhile, in recent years, auto parts are increasingly required to have better performance and longer life. Particularly, there has been strong desire to improve the performance of these slidable parts. Iron base sintered alloys are admittedly excellent in anti-wear property and are found advantageous as materials for slidable parts to serve under a relatively low plane pressure. When applied, however, in service under a high plane pressure, the sintered alloys, which are highly porous, do not permit formation of a stable lubricant film on account of the porosity which absorbs the oil. Besides, they have such a low strength that they are liable to buckle or collapse under a high plane pressure in service and are vulnerable to pitting, which is a result of local fatigue on the surface. For these reasons iron base sintered alloys have seldom been put to use in high plane pressure service.

SUMMARY OF THE INVENTION

The wear-resisting sintered alloy according to the present invention represents an improvement in an iron base sintered alloy. It is obtained by virtually the same conventional process but with the alloy compositions: 15–25% Cr, 0–3% Mo, 1–5% Cu, 0.3–0.8% P, 2.0–4.0% C and the balance iron.

The object of the present invention is to provide a wear-resisting sintered alloy characterized by high density, high hardness, better profile distribution of precipitate carbides, low abrasiveness to the companion part as well as its own high resistance to wear and pitting, and which can advantageously be employed as material for slidable auto parts to serve under a relatively high plane pressure.

DETAILED EXPLANATION OF THE INVENTION

A detailed explanation of the wear-resisting sintered alloy according to the present invention follows.

Figure 1:
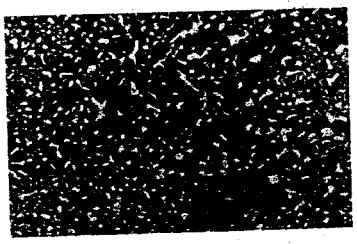
FIG. 1 is a microphotograph (×400) showing the structure of a sintered alloy according to one embodiment of the present invention.

The sintered alloy according to the present invention is a high density, high hardness iron base sintered alloy characterized by its density being over 7.3 g/cm$^3$, the hardness being 400–700 Hv (Vickers hardness) and the composition, by weight, consisting essentially of Cr: 15–25%, Mo: 0–3%, Cu: 1–5%, P: 0.3–0.8%, C: 2.0–4.0%, the balance being Fe and less than 2% impurities which are contained in ordinary iron base sintered alloys. As illustrated in FIG. 1, the sintered alloy according to the present invention represents very hard, fine composite carbides such as $(Fe, Cr)_7C_3$ or $(Fe, Cr, Mo)_7C_3$ evenly distributed in a firm matrix of an Fe-Cr-(Mo)-Cu-P-C system ($\alpha$ phase$+\gamma$ phase). This alloy can be produced with the high density and high hardness above by practically the same process which is employed to produce the conventional iron base sintered alloy, and the results of its abrasion test are extremely good.

The following are examples of the alloys of the present invention.

EXAMPLE 1

Figure 3:
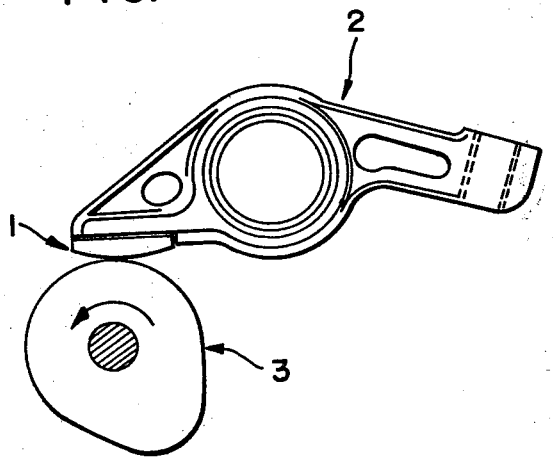
FIG. 3 is a side view illustrating an abrasion test arrangement.

Atomized alloy powder of less than 100 mesh with the following composition, by weight: Cr, 17%; Mo, 1%; Cu, 2%; P, 0.5%; the balance being Fe and less than 2% impurities which are commonly contained in the ordinary iron base sintered alloy, were prepared and to this powder was added C, 2.5% in the form of a natural scaly graphite powder as the carbon source, and a zinc stearate powder as the lubricant. The powder thus obtained was evenly blended in a mixer, followed by press-forming in a metal mold under a pressure of 6.5 tons/cm$^2$, whereby a molded product of density 6.2–6.4 g/cm$^3$ was obtained. This product was then submitted to sintering 1100°–1200° C.×60 minutes, in an atmosphere of decomposed ammonia gas ($N_2+H_2$). Thus the sintered alloy according to the present invention was obtained in just the same way as the conventional iron base sintered alloy. The obtained alloy was measured for density and hardness and put to an abrasion test to determine the amount of the pad (follower) wear and cam wear. For this test a rocker arm pad 1 as illustrated in FIG. 3 for a diesel engine of 2200 cc displacement with an O.H.C. (overhead cam) valve mechanism was fabricated of the sintered alloy thus obtained; this pad 1 was brazed to the rocker arm 2 and engaged a chilled cast iron cam 3, and the engine was tested. In this test a single engine was put through 5 cycles, totaling 1000 hours, of 4400 r.p.m.×full load×50 hours×2000 r.p.m.×no load×150 hours, and the maximum worn depth was measured in both the pad and the cam.

In the same way as in Example 1, other alloys according to the present invention and control alloys with different composition were prepared and submitted to density and hardness measurements, and the above abrasion test. The composition, density, hardness of these alloys and the results of their abrasion tests, including those of Example 1, are summarized in the following table.

TABLE

| | Composition in Wt. % | Density g/cm³ | Hardness Hv (10kg) | Results on abrasion test Pad wear Depth | Cam wear Depth |
|---|---|---|---|---|---|
| Example 1 | Fe—17%Cr—1%Mo—2%Cu—0.5%P—2.5%C | 7.6 | 630 | 7μ | 28μ |
| Example 2 | Fe—25%Cr—5%Cu—0.8%P—3.5%C | 7.4 | 450 | 5μ | 53μ |
| Example 3 | Fe—16%Cr—3%Mo—3%Cu—0.3%P—3.0%C | 7.7 | 650 | 5μ | 32μ |
| Example 4 | Fe—15%Cr—1%Cu—0.5%P—2.0%C | 7.4 | 580 | 2μ | 62μ |
| Example 5 | Fe—17%Cr—2%Mo—5%Cu—0.5%P—4.0%C | 7.7 | 600 | 2μ | 38μ |
| Control 1 | Hard Chromium Plating | — | 950* | 370μ | 180μ |
| Control 2 | Fe—5.3%Cr—1.3%Mo—1.2%W —0.4%V—1.1%Si—0.39%C (Material through fusion: SKD63) | — | 670 | 230μ | 160μ |
| Control 3 | Fe—17%Cr—1%Mo—2%Cu—2.5%C (Sintered alloy) | 6.3 | 310 | 510μ | 2,360μ |
| Control 4 | Fe—17%Cr—1%Mo—2%Ni—0.5%P—2.5%C (Sintered alloy) | 7.7 | 600 | 22μ | 450μ |
| Control 5 | Ni—5%Mo—50%Tic/Tin (Sintered cermet) | 7.9 | 780 | 8μ | 3,740μ |

Note:
*represents Hv (0.1 kg)

Control 4 was obtained by the same process used for the sintered alloy according to the present invention. Control 3 was obtained using a commercially available SUS434 powder (Fe-17%Cr-1%Mo), electrolytic copper powder and natural scaly graphite powder by the same process as employed for the sintered alloy according to the present invention. Control 1 represents a conventionally available alloy $SCr_3$ quenched and tempered with its surface chromium-plated.

As seen from the above results, this abrasion test, in which a diesel engine was used and in consequence, fine soot in the burned gas got mixed in the lubricant during testing, proved a very severe one, whereby even the hard chromium-plated rocker arm usually employed suffered a heavy wear, but the sintered alloy according to the present invention, which represents fine carbides uniformly distributed in a firm matrix of $(\alpha+\gamma)$ phase, exhibited high anti-wear properties with the result that both pad and cam turned out satisfactory with respect to wear, e.g. the companion part was not worn either. The size of carbide in the sintered alloy was measured as 5–6μ by using a "QTM-machine" manufactured by Metal Research Co. in England. Also, the sintered alloy according to the present invention showed high density (over 7.3 g/cm³) and high hardness (Hv 400–700), proving itself to be able to stand high plane pressure.

Next, the aims and quantitative limitations of respective elements employed in the sintered alloy according to the present invention will be explained.

P is generally known to promote the sintering of an Fe base alloy and it has proved itself to show a prominent effect in the sintered alloy according to the present invention.

It is due to the effect of P that, as illustrated in the example, a high-density sintered product could be obtained at an ordinary sintering temperature of 1100°–1200° C.; in the control 3 with no addition of P, the density was as low as 6.3 g/cm³. Such an effect of P is prominent at over 0.3% content and the content 0.8% is found sufficient. Thus the content of P is set at 0.3–0.8%.

C is valued as an effective element, a part of which combines with Cr, Mo to form a composite carbide, like $(Fe,Cr)_7C_3$ or $(Fe, Cr, Mo)_7C_3$, which improves the anti-wear property, the balance serving to enhance the hardness and strength of the matrix. In the sintered alloy according to the present invention, less than 2% C is not sufficient to give the necessary hardness and the necessary quantity of carbides; more than 2% C is needed to assure a satisfactory anti-wear property under high plane pressure.

At over 4% C, however, the carbide grains become so coarse as to abrade the companion part. Thus the desirable value of C-content is set at less than 4%.

Cr partially precipitates as a solid solution in the matrix and strengthens the latter, but the greater portion of it combines with C to yield carbide grains. At less than 15% Cr, the C-content is too high for the Cr-content, undesirably coarsening the carbide grains. Thus Cr-content is set at more than 15%. Meanwhile, the larger the Cr-content, the greater is its effect; at over 25% Cr, however, the effect of increased Cr diminishes, causing an enrichment of γ-phase of the Fe-Cr system in the material powder, which hinders the molding of the powder. Thus Cr-content is set at less than 25%.

Mo is generally deemed as effective an element as Cr for improving the wear resistance by strengthening the matrix and yielding carbides. In the sintered alloy according to the present invention which is rich in Cr and wear-resistant enough, the effect of Mo is not great. When Mo is added to this alloy, however, most of carbides yielded are $(Fe, Cr, Mo)_7C_3$ and, being more spheroidized, they are less abrasive to the companion part. Mo is thus effective for decreasing the abrasion to the companion part; but when its content exceeds 3%, a carbide network develops at the grain boundary of the matrix, thereby deteriorating the anti-pitting property. Thus Mo-content should be less than 3%.

Figure 2:
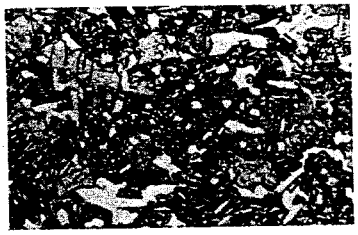
FIG. 2 is a microphotograph (×400) showing the structure of a conventional sintered alloy (control No. 4)

Just as in the ordinary iron base sintered alloy, Cu is finely precipitated in the matrix while cooling after sintering and contributes to the alloy strength, but the most important effect of Cu in this sintered alloy lies in making the carbides fine and spheroidizing them. FIG. 1 illustrates the microstructure of a sintered alloy according to the present invention and FIG. 2 shows the microstructure of the control 4 alloy. Carbides in them are widely different in profile and accordingly a wide different develops as seen from the table in cam wear, testifying to an extremely great effect of Cu. The effect is evident at over 1% Cu, but when 5% is exceeded, the effect becomes negative, weakening the grain boundary of the matrix and lowering the anti-pitting property.

As explained above, an iron base sintered alloy with the composition according to the present invention, acting well free from all the conventional troubles even in application to slidable machine parts to serve under a relatively high plane pressure by virtue of its high density, high hardness and anti-wear property, is found very highly satisfactory as an auto material calling for increasingly better performance and longer life, particularly so as the material of wearable parts exposed to high plane pressure such as cam, rocker arm pad, valve lifter, and valve stem tip in the internal combustion engine; and as a wear-resisting material in general. Thus the present invention with its wide applicabilities is considered industrially of high value.

We claim:

1. A wear-resisting iron base sintered alloy comprising a sintering of more than 7.3 g/cm$^3$ density, of a metal powder composed of Cr, 15–25%; Mo, 0–3%; Cu, 1–5%, P, 0.3–0.8%; and C, 2.0–4.0%; the balance being Fe and less than 2% impurities.

2. Sintered alloy of claim 1, wherein Mo-content is zero.

3. Sintered alloy of claim 1, wherein Mo-content is less than 3%.

4. Sintered alloy of claim 1, comprising hard, fine composite carbides evenly distributed in a matrix of Fe-Cr-(Mo)-Cu-P-C system.

5. Sintered alloy of claim 4, wherein said composite carbides are $(Fe, Cr)_7C_3$ or $(Fe, Cr, Mo)_7C_3$.

6. Sintered alloy of claim 4, wherein the size of composite carbide is 5–6$\mu$.

7. Sintered alloy of claim 1, which is 400–700 in Hv hardness.

8. Sintered alloy of claim 1, which is obtained by press forming an alloy powder in a metal mold and heating the molded product.

9. Sintered alloy of claim 8, wherein press forming is done under a pressure of 6.5 t/cm$^2$ to yield a molded product with density 6.2–6.4 g/cm$^3$.

10. Sintered alloy of claim 1, wherein the sintering is done at 1100°–1200° C. for 60 minutes in an atmosphere of decomposed ammonia gas.

* * * * *